US012384505B1

(12) United States Patent
Broughton et al.

(10) Patent No.: US 12,384,505 B1
(45) Date of Patent: Aug. 12, 2025

(54) WATERCRAFT WITH AN ELECTRIC MOTOR

(71) Applicant: BRP MARINE US INC., Clinton, MI (US)

(72) Inventors: George Broughton, Wadsworth, IL (US); James Macier, Beach Park, IL (US); Anthony Lavigna, Beach Park, IL (US)

(73) Assignee: BRP Marine US Inc.

( * ) Notice: Subject to any disclaimer, the term of this patent is extended or adjusted under 35 U.S.C. 154(b) by 617 days.

(21) Appl. No.: 17/732,719

(22) Filed: Apr. 29, 2022

Related U.S. Application Data

(60) Provisional application No. 63/182,440, filed on Apr. 30, 2021.

(51) Int. Cl.
*B63H 21/17* (2006.01)
*B63B 1/14* (2006.01)

(52) U.S. Cl.
CPC ..... *B63H 21/17* (2013.01); *B63B 1/14* (2013.01)

(58) Field of Classification Search
CPC ..... B63H 21/17; B63H 1/14; B63B 1/14
See application file for complete search history.

(56) References Cited

U.S. PATENT DOCUMENTS 3,619,632 A * 11/1971 Labombarde ..... B63J 3/04 114/39.21
4,494,472 A * 1/1985 Rougerie ..... B63C 11/49 114/61.15
5,760,569 A * 6/1998 Chase, Jr. ..... H01M 50/204 414/281
5,806,232 A * 9/1998 James ..... A01K 91/02 43/26.1
7,452,251 B2 11/2008 Boebel
7,614,925 B2 11/2009 Boebel et al.
8,337,264 B2 12/2012 Boebel
10,124,870 B2 11/2018 Bergmann et al.
10,464,651 B2 11/2019 Rebele et al.
(Continued)

OTHER PUBLICATIONS

Great for Pontoon Boats, Pure Watercraft, Online Reference Retrieved on Feb. 5, 2022, https://www.purewatercraft.com/product/electric-repower-pontoon-boat/, 8 pages.
(Continued)

*Primary Examiner* — Stephen P Avila
(74) *Attorney, Agent, or Firm* — BCF LLP

(57) ABSTRACT

A watercraft including a hull including a bottom surface, a channel being defined by the bottom surface; a deck disposed above the hull; a battery disposed in a rear portion of the watercraft below the deck; an electric motor disposed in a forward portion of the watercraft, the electric motor being disposed above the bottom surface of the hull and below the deck, the electric motor being electrically connected to the battery; a propulsion shaft operatively connected to the electric motor at a front end of the propulsion shaft, the propulsion shaft extending downward and rearward from the electric motor, the propulsion shafting passing through the bottom surface of the hull and extending into the channel; a propeller connected to a rear end portion of the propulsion shaft; and a rudder pivotally connected to at least one of the hull and the deck.

21 Claims, 12 Drawing Sheets

(56) References Cited

U.S. PATENT DOCUMENTS

| | | | | |
|---|---|---|---|---|
| 10,647,398 | B2 | 5/2020 | Biebach | |
| 10,654,551 | B1 | 5/2020 | Doremus et al. | |
| 2009/0165696 | A1* | 7/2009 | Burroughs | B63B 3/14 114/355 |
| 2020/0140049 | A1 | 5/2020 | Gil et al. | |
| 2020/0255110 | A1 | 8/2020 | Doremus et al. | |
| 2020/0255112 | A1 | 8/2020 | Doremus et al. | |

OTHER PUBLICATIONS

Brio Electric Series, Pontoon Boats, Princecraft®, Online Reference Retrieved on Feb. 5, 2022, https://www.princecraft.com/ca/en/products/Pontoon-Boats/2022/Brio-Electric-Series.aspx, 8 pages.

* cited by examiner

WATERCRAFT WITH AN ELECTRIC MOTOR

CROSS-REFERENCE

The present application claims priority to U.S. Provisional Patent No. 63/182,440, entitled "Watercraft with an Electric Motor," filed Apr. 30, 2021, the entirety of which is incorporated herein by reference.

FIELD OF TECHNOLOGY

The present technology relates to watercraft, and more specifically to watercraft having an electric motor.

BACKGROUND

In watercraft, hydrodynamic drag exerted on the watercraft's hull as it moves through water may consume a substantial portion of the watercraft power and energy. At lower speeds, drag is usually greater as the watercraft travels lower in the water. Many watercraft are thus generally configured to get "on plane" at higher speeds, wherein the watercraft rides mostly above the water and thereby reduces hydrodynamic drag significantly.

Recreational watercraft with electric propulsion systems tend to be significantly heavier than similar watercraft having conventional powertrains, which generally results in the watercraft sitting lower in the water, thereby increases hydrodynamic drag. The added weight can further make it harder for the watercraft to get on plane. This challenge is even greater for large recreational marine vessels, such as pontoons. As the electric watercraft has greater drag, due to both the lower position in water and reduced time on plane, energy from the battery is consumed by drag at a substantial rate thereby decreasing the overall range of the watercraft.

As interest grows in converting recreational vehicles to electric propulsion systems, solutions have been proposed for retrofitting pontoon boats with an electric propulsion system. Some such electric pontoons replace a conventional gasoline powered outboard engine with an electric outboard engine with batteries or battery packs stored in the boat.

While retrofitting an existing pontoon boat limits the need for a full watercraft redesign, battery pack placement is constrained to existing storage spaces in the boat. Using the existing storage locations, however, limits the size and number of battery packs utilized and may not allow for an optimal weight distribution. In addition to boat handling, non-optimal weight distribution can also further impact the ability of the watercraft to get on plane.

Thus, there is a desire for a recreational watercraft designed for an electric propulsion system with improved range.

SUMMARY

It is an object of the present technology to ameliorate at least some of the inconveniences present in the prior art.

According to one aspect of the present technology, there is provided a watercraft with an electric propulsion system, formed from a deck and hull with the electric powertrain being received in part between the hull and the deck. The hull structure provides a relatively large volume for the watercraft to counteract the weight of the electric powertrain and to decrease the hull surface area in the water to decrease drag at low speeds. The volume formed between the hull and the deck receives the electric motor, the battery, and other electric components, with the different components being arranged to aid in providing suitable weight distribution. The hull also includes inclined panels in a forward portion thereof to further aid the watercraft into getting on plane during operation. With the electric motor disposed in a forward portion of the watercraft, a propulsion shaft extends into a channel in the hull to provide inboard drive for the propeller, with the battery being disposed in a rear portion to balance the weight distribution. Components disposed in the volume between the hull and the deck are also configured to be waterproof, such that the hull need not be sealably connected to the hull and the pontoon tubes, reducing the complexity of construction for the watercraft. Waterproof buoyant material is further included to aid in increasing buoyancy.

According to an aspect of the present technology, there is provided a watercraft including a hull including a bottom surface, a channel being defined by the bottom surface; a deck disposed above the hull; a battery disposed in a rear portion of the watercraft, the battery being disposed above the bottom surface of the hull and below the deck; an electric motor disposed in a forward portion of the watercraft, the electric motor being disposed above the bottom surface of the hull and below the deck, the electric motor being electrically connected to the battery; a propulsion shaft operatively connected to the electric motor at a front end of the propulsion shaft, the propulsion shaft extending downward and rearward from the electric motor, the propulsion shafting passing through the bottom surface of the hull and extending into the channel; a propeller connected to a rear end portion of the propulsion shaft; and a rudder pivotally connected to at least one of the hull and the deck.

In some embodiments, the bottom surface of the hull includes: a first portion including at least one inclined surface extending downward and rearward from a front edge portion of the bottom surface; and a second portion extending rearward from the first portion at an angle from the first portion.

In some embodiments, the at least one inclined surface includes: a right surface section disposed laterally between the channel and the right tube, and a left surface section disposed laterally between the channel and the left tube.

In some embodiments, an interior angle formed by the at least one inclined surface and the second portion of the bottom surface is at least 140 degrees.

In some embodiments, the interior angle formed by the at least one inclined surface and the second portion of the bottom surface is approximately 160 degrees.

In some embodiments, a front edge of the first portion is a connected to a bottom surface of the deck.

In some embodiments, a longitudinal length of a horizontal projection of the first portion is equal to at least 20% of an overall length of the watercraft.

In some embodiments, the channel is defined in at least the second portion of the bottom surface.

In some embodiments, the channel is further defined in the first portion of the bottom surface.

In some embodiments, a shaft aperture is defined in the hull; and the propulsion shaft extends through the shaft aperture.

In some embodiments, the shaft aperture is defined in a portion of the bottom surface defining the channel.

In some embodiments, a drive axis is defined by a line extending through the front end of the propulsion shaft, and a center of rotation of the propeller and the drive axis extends downward and rearward from the deck at a drive angle of less than 15 degrees.

In some embodiments, the drive angle is approximately 11 degrees.

In some embodiments, the channel extends along a longitudinal center plane of the watercraft.

In some embodiments, the propulsion shaft extends along the longitudinal center plane of the watercraft.

In some embodiments, the watercraft further includes buoyant material disposed between the hull and the deck.

In some embodiments, the electric motor and the battery are disposed vertically higher than the buoyant material.

In some embodiments, at least one area of contact between the hull and the deck is water-permeable.

In some embodiments, a plurality of electrical components are disposed between the hull and the deck; the plurality of electrical components include at least the battery and the electric motor; and the plurality of electrical components are configured to be water-proof.

In some embodiments, the propulsion shaft includes a drive shaft operatively connected to the electric motor; a propeller shaft connected to the propeller; and a coupling connecting the propeller shaft to the drive shaft.

In some embodiments, the propeller is disposed at least partially rearward of the channel.

In some embodiments, the battery and the electric motor are disposed vertically over the channel.

In some embodiments, a longitudinal length of the hull is at least 4 meters.

In some embodiments, a longitudinal length of the hull is less than 8 meters.

In some embodiments, the hull is a multihull including at least: a left hull, and a right hull; and the channel is defined between the left hull and the right hull.

In some embodiments, the hull includes a surface extending above the channel and between the left hull and the right hull; and the battery and the electric motor are received on the surface.

In some embodiments, a width of the channel is approximately 25% of a total width of the watercraft.

For purposes of this application, terms related to spatial orientation such as forwardly, rearwardly, longitudinally, upwardly, downwardly, laterally, left, and right, are as they would normally be understood by an operator in the watercraft and facing a bow of the watercraft. Terms related to spatial orientation when describing or referring to components or sub-assemblies of the watercraft, separately from the watercraft, should be understood as they would be understood when these components or sub-assemblies are mounted to the watercraft, unless specified otherwise in this application.

As used herein, the term "approximately" in the context of a given value or range refers to a value or range that is within 10% of the given value or range.

Embodiments of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects and advantages of embodiments of the present technology will become apparent from the following description, the accompanying drawings and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

It should be noted that the Figures may not be drawn to scale.

DETAILED DESCRIPTION

Figure 1:
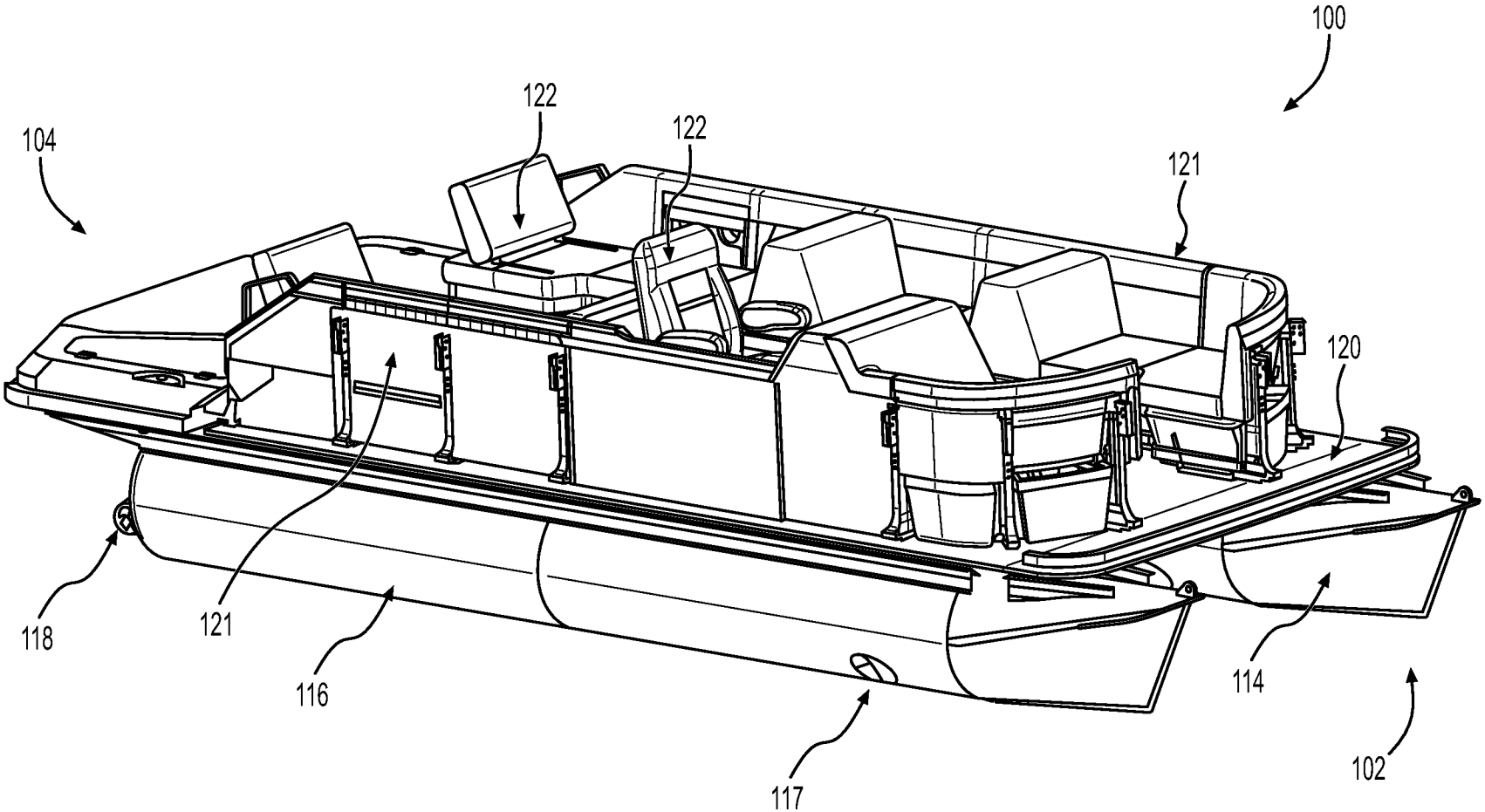
FIG. 1 is a front, right side perspective view of a watercraft according to a non-limiting embodiment of the present technology.
Figure 2:
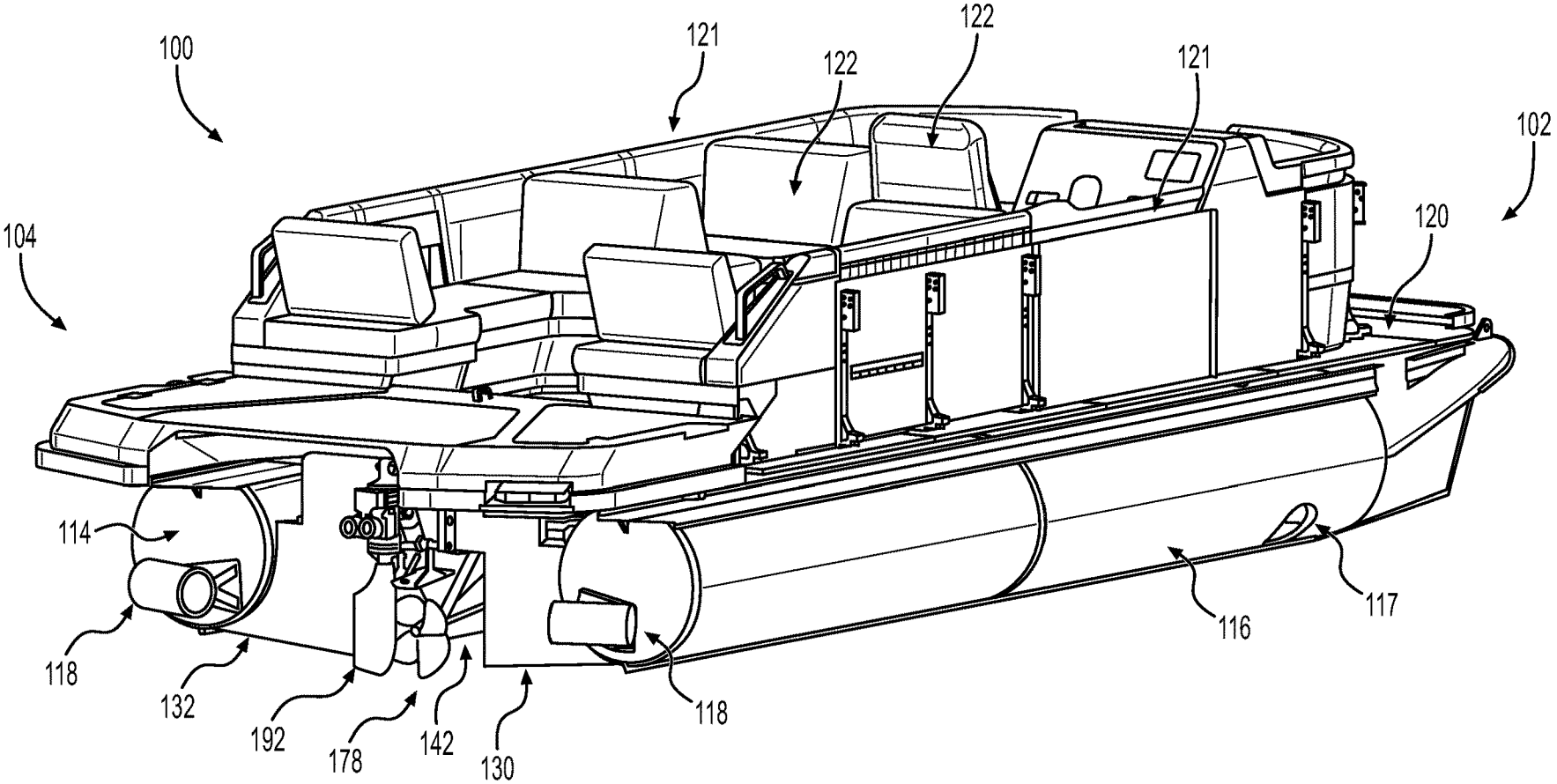
FIG. 2 is a rear, right side perspective view of the watercraft of FIG. 1.
Figure 3:
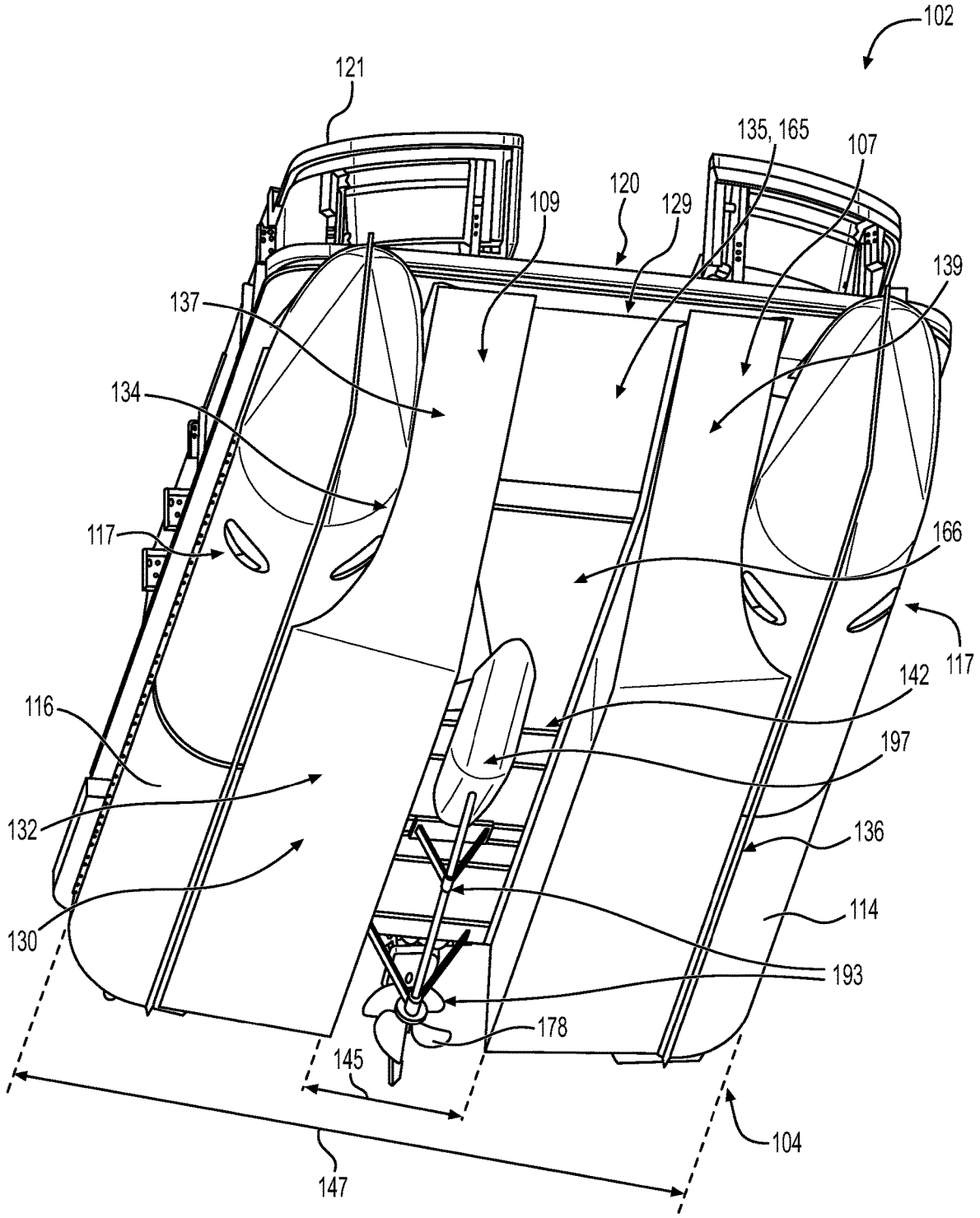
FIG. 3 is a bottom, front, right side perspective view of the watercraft of FIG. 1.

A watercraft 100 in accordance with one embodiment of the present technology is shown in FIGS. 1 to 3. The following description relates to one example of a watercraft, notably a pontoon boat 100 with an inboard electric propulsion system 150. Those of ordinary skill in the art will recognize that there are other known types of watercrafts incorporating different designs and that at least some aspects of the present technology would encompass these other watercrafts.

Figure 9:
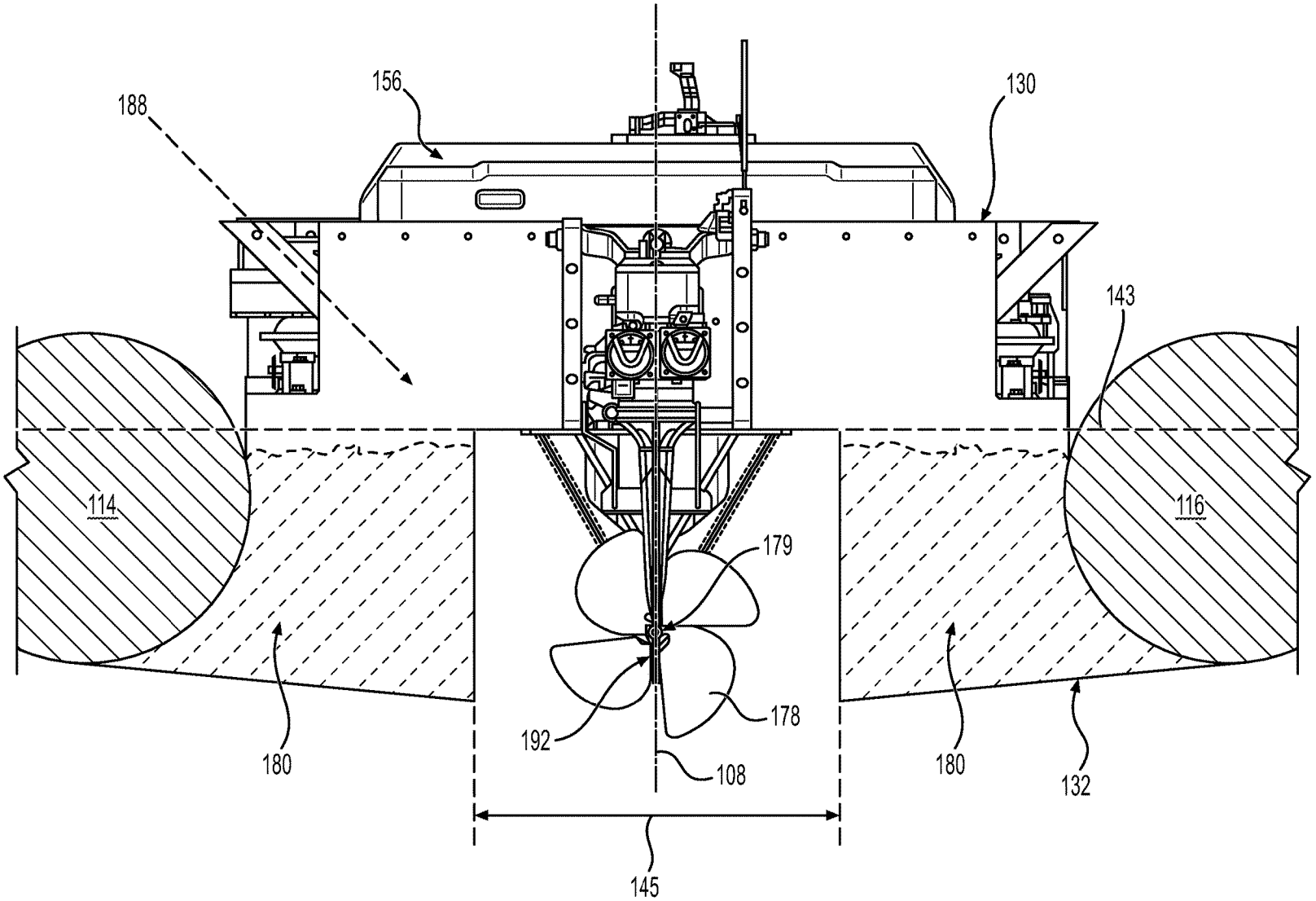
FIG. 9 is a rear elevation view of the hull, the propulsion system, and the rudder of FIG. 7, with an embodiment of buoyant material illustrated schematically.

The watercraft 100 has a front end 102, also referred as a bow 102, and a rear end 104, also referred to as a stern 104. A longitudinal center axis 106 of the watercraft 100 is defined from the front end 102 to the rear end 104. A longitudinal center plane 108 is also defined for the watercraft 100, as is also illustrated in FIG. 9. The longitudinal center plane 108 is aligned with the center axis 106 from the front end 102 to the rear end 104 and extends vertically to transect the watercraft 100 into two lateral halves, left and right.

The watercraft 100 includes a pair of sealed pontoon tubes, also referred to as pontoons: a left tube 114 and a right tube 116. Each tube 114, 116 includes a rear-mounted thruster 118 and a forward thruster 117 disposed in a forward portion of the tubes 114, 116 for aiding in handling operation of the watercraft 100. In some embodiments, one or both of the thrusters 117, 118 could be omitted.

The watercraft 100 includes a deck 120 supported by the tubes 114, 116. The deck 120 is formed from a composite polymer panel covered by watercraft carpeting, although the particular materials forming the deck 120 could vary in different embodiments. For example, wood panels could be used to for the deck 120, as is common in conventional pontoon boats. The deck 120 has an upper surface for supporting occupants, as well as accessories and accommodations of the watercraft 100 (e.g., seating, command console, etc.). In this embodiment, the deck 120 receives thereon various railing structures 121 and seating structures 122, although the particular arrangement could vary from the illustrated embodiment.

Figure 4:
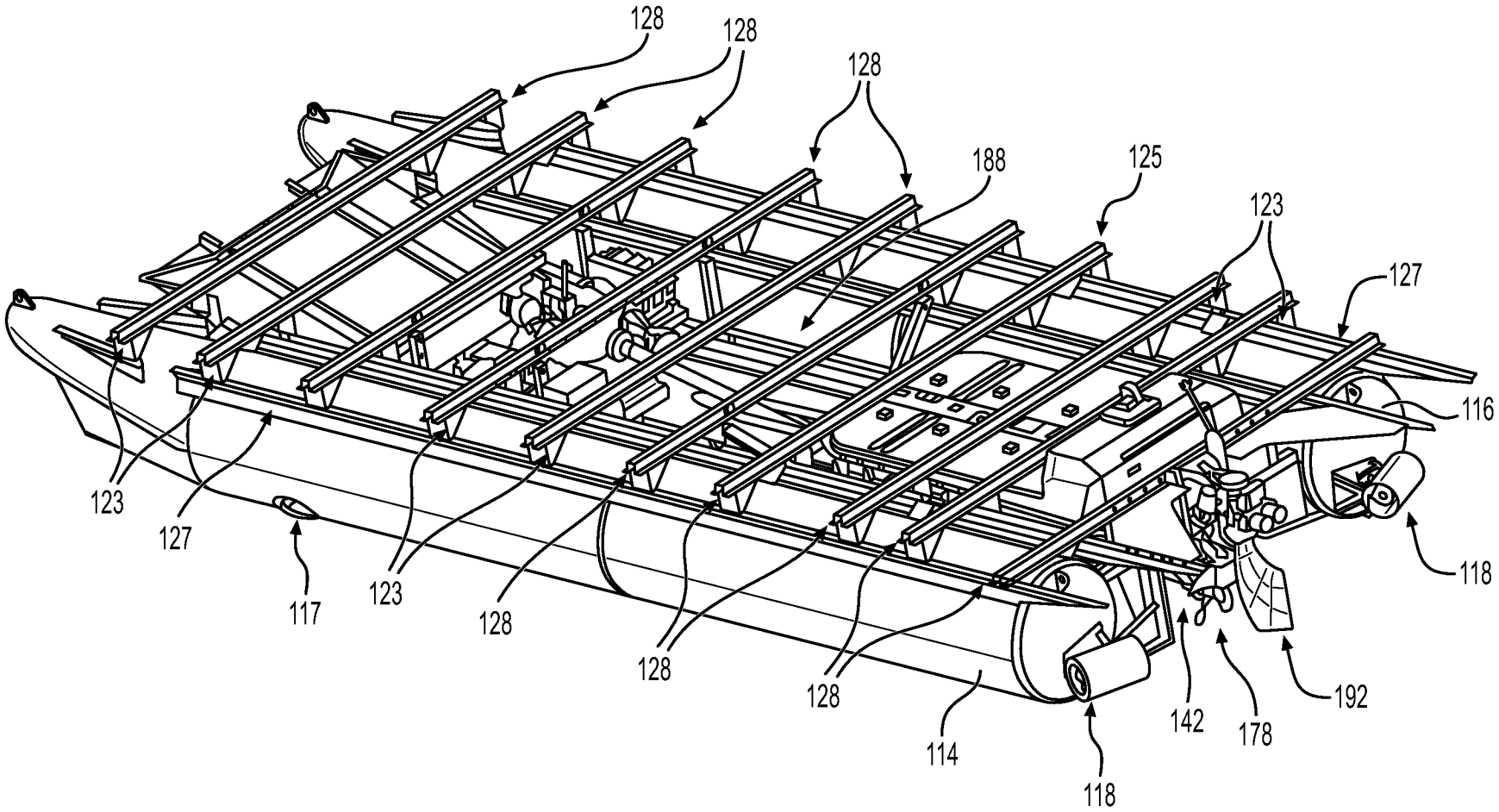
FIG. 4 is a top, rear, left side perspective view of the watercraft of FIG. 1, with a deck removed.
Figure 5:
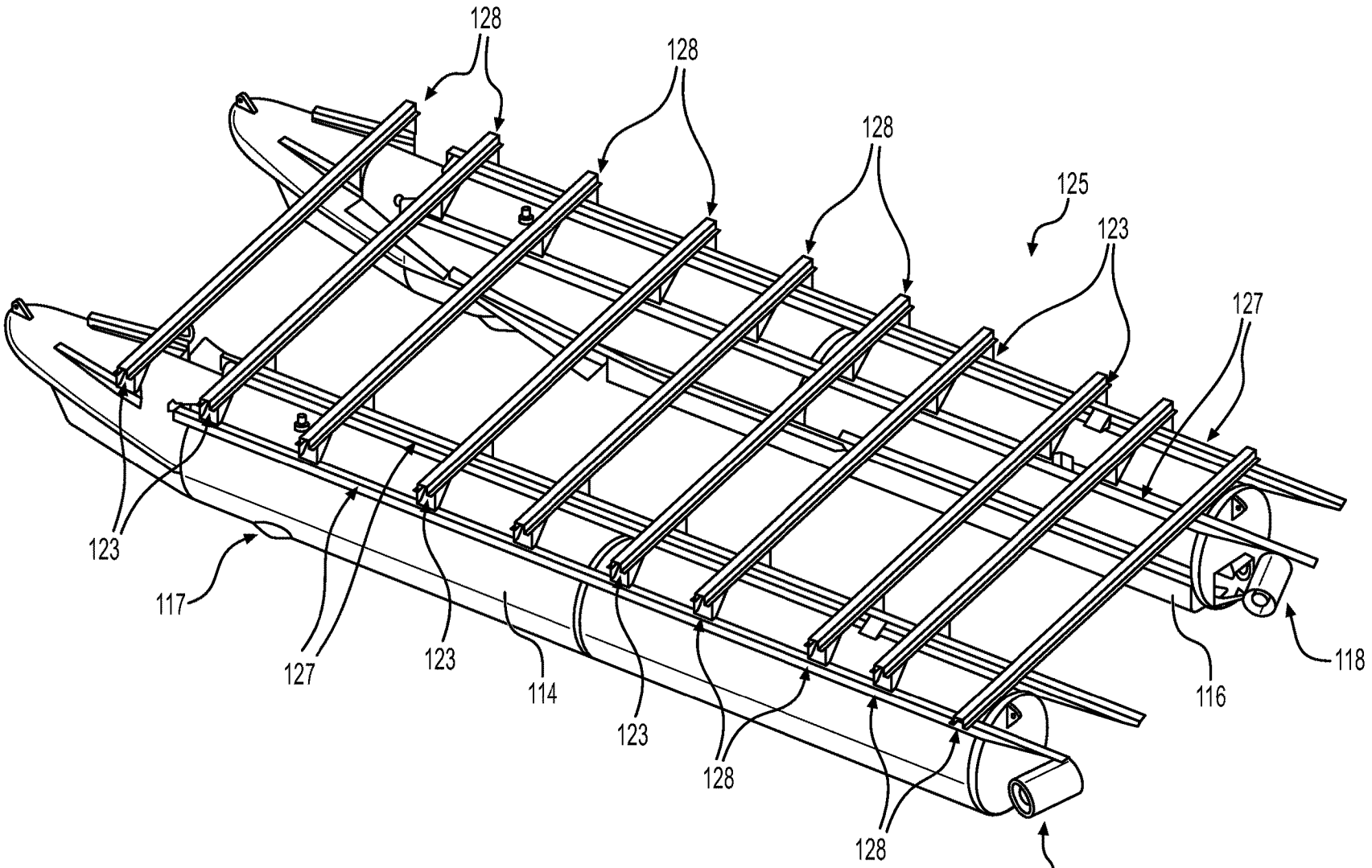
FIG. 5 is a top, rear, left side perspective view of pontoon tubes and a support structure of the watercraft of FIG. 1.
Figure 6:
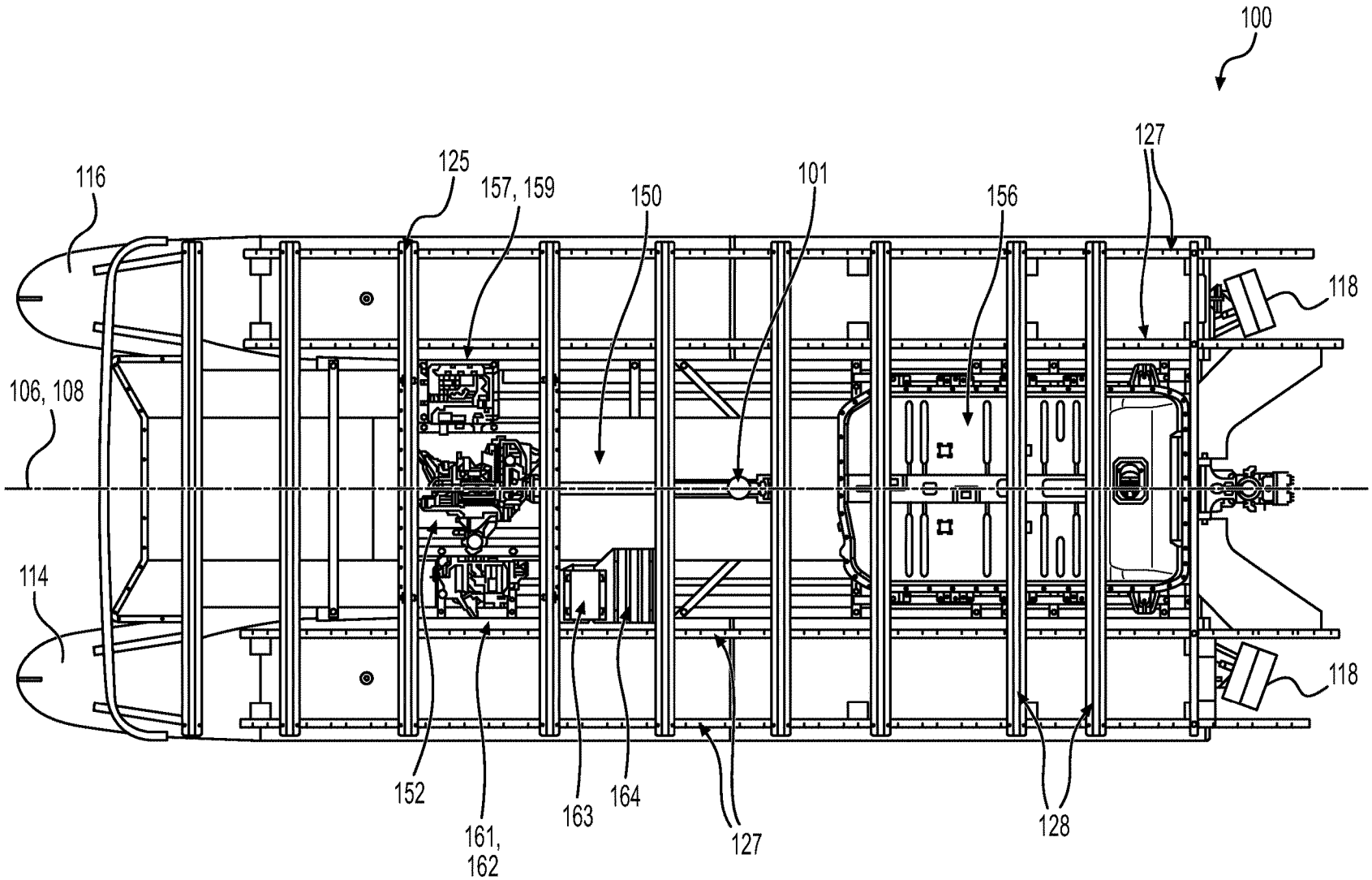
FIG. 6 is a top plan view of the watercraft of FIG. 1, with the deck removed.

With additional reference to FIGS. 4 to 6, the present embodiment of the watercraft 100 includes a support structure 125 extending between the tubes 114, 116 for receiving the deck 120. The support structure 125 and the tubes 114, 116 are illustrated in isolation in FIG. 5. The support structure 125 is formed from two left longitudinal rigid members 127 connected to the left tube 114, two right longitudinal rigid members 127 connected to the right tube 116, twenty brackets 123, commonly referred to as deck risers, and ten lateral rigid members 128, commonly referred to as deck risers. Each lateral member 128 is connected by its end portions to the right and left rigid members 127 by one of the brackets 123. It is contemplated that more or fewer rigid members 127, 128 could be utilized in different embodiments of the support structure 125. It is also contemplated that in some embodiments of the watercraft 100, elements of the support structure 125 could be omitted, such as the deck risers, or that the support structure 125 could be omitted in its entirety. For example, the deck 120 could be configured and arranged to connect directly to the tubes 114, 116.

The watercraft 100 also includes a hull 130 disposed below the deck 120 and between the left and right tubes 114, 116. The hull 130 is connected to a bottom side of the deck 120 near the front and rear ends 102, 104 of the watercraft 100 and to the pair of tubes 114, 116. As will be described further below, the hull 130 is not sealed to the deck 120 and the tubes 114, 116 and thus these seams are generally water-permeable. It is contemplated that the hull 130 could be connected to the deck 120 and/or the tubes 114, 116 with rivets, bolts and/or welds, although other means of connection are possible. In some embodiments, it is also contemplated that the hull 130 could be connected directly to the support structure 125. It is also contemplated that the hull 130 could be connected to only the deck 120 or only the tubes 114, 116. It is further contemplated that in some embodiments, the tubes 114, 116 could be omitted and compensated for by the hull 130. In such embodiments, the hull 130 could be formed to occupy a volume equal to that of the tubes 114, 116 and the hull 130 of the illustrated embodiments.

With additional reference to FIGS. 7 to 9, between the hull 130, the deck 120, and the tubes 114, 116 is defined a volume 188 of the watercraft 100 in which are received components of the inboard electric propulsion system 150 and buoyant material, as will be described in further detail below. While not sealing edges of the hull 130 to the deck 120 and the tubes 114, 116 reduces complexity of construction of the watercraft 100, some infiltration of water into the volume 188 is possible. As will be discussed below, however, the watercraft 100 is configured to allow infiltration during normal operation.

The hull 130 has a bottom surface 132 arranged to contact water when the watercraft 100 is in use. The bottom surface 132 includes two integrally connected portions: a forward portion 134 and a rearward portion 136. The bottom surface 132 extends between the tubes 114, 116 and defines a channel 142 in the hull 130. The channel 142 is defined partially in both the forward and rearward portions 134, 136 as will be described in further detail below.

The forward portion 134 of the bottom surface 132 of the hull 130 extends downward and rearward from a front edge 129 in contact with the deck 120 to provide an angled bottom surface portion. The rearward portion 136 extends rearward from the forward portion 134 at an angle to the forward portion 134. Specifically, the rearward portion 136 is arranged generally horizontally and parallel to the deck 120. An interior angle 199 formed by the forward portion 134 and the rearward portion 136 is at least 140 degrees (see FIG. 8). In the present embodiment, the interior angle 199 is approximately 160 degrees.

As shown in FIG. 3, the forward portion 134 includes a right surface section 137 disposed laterally between the channel 142 and the right tube 116, and a left surface section 139 disposed laterally between the channel 142 and the left tube 114. Each of the right surface section 137 and the left surface section 139 is an inclined surface extending downward and rearward from the front edge portion 129 of the bottom surface 132 and arranged at the interior angle 199 to the rearward portion 136. The surfaces 137, 139 also incline and extend downward and inward laterally from the tubes 114, 116 toward the center plane 108. The inclined surface sections 137, 139 aid the watercraft 100 in achieving an on plane condition, in order to aid in reducing drag and thus power consumption.

The forward portion 134 also includes a center portion 135 disposed between the right surface section 137 and the left surface section 139 and centered on the center plane 108. The center portion 135 includes an inclined forward portion 165 extending downward from the front edge 129 and a generally horizontal portion 166 extending rearward from the portion 165 and defining a forward part of the channel 142. It is contemplated that the forward portion 134 could include only one inclined surface in some embodiments, for example an angled surface extending forward of the channel 142 and along the right and left sides thereof.

It should be noted that the term "rearward" for the rearward portion 136 is employed simply to denote that the portion 136 is disposed rearward of the forward portion 134. As can be seen from the Figures, the rearward portion 136 of the present embodiment extends partially forward of a longitudinal midpoint of the watercraft 100. In particular, a longitudinal length 144 of a horizontal projection of the forward portion 134 is equal to approximately at least 20% of an overall longitudinal length 146 of the watercraft 100 and/or the hull 130. In the present embodiment, the overall length 146 of the hull 130 is approximately 6 meters. The exact length 146 could vary in different embodiments, with the length 146 preferably being at least 4 meters and less than 8 meters.

As is mentioned above, the hull 130 has the channel 142 defined therein by the bottom surface 132. The channel 142 extends along the bottom of the watercraft 100 and is centered on the longitudinal center plane 108. The channel 142 is defined by and extends through the rearward portion 136 and a rear part of the forward portion 134, specifically by horizontal portion 166 between the inclined surfaces 137, 139. It is contemplated, depending on the exact dimensions of the watercraft 100 and the forward and rearward portions 134, 136, that the channel 142 could be defined by only the rearward portion 136 in some embodiments.

Briefly, the channel 142 aids in providing adequate water flow to an inboard motor-driven propeller 178, disposed slightly rearward of the channel 142. The exact width of the channel 142 could therefore depend on various factors, including but not limited to: operational details of the propeller 178, size and weight of the watercraft 100, and other hydrodynamic factors. A maximum width 145 of the channel 142 (see additionally FIG. 9) of the present embodiment, defined at the laterally widest point of the channel 142 is approximately 600 mm and is approximately 25% an overall width 147 of the watercraft 100. The channel width 145 is generally less than 30% of a total width of the hull 130. Depending on the embodiment, the exact maximum width 145 could vary, although the width 145 is generally at least 400 millimeters for a similar embodiment of the hull 130.

Figure 11:
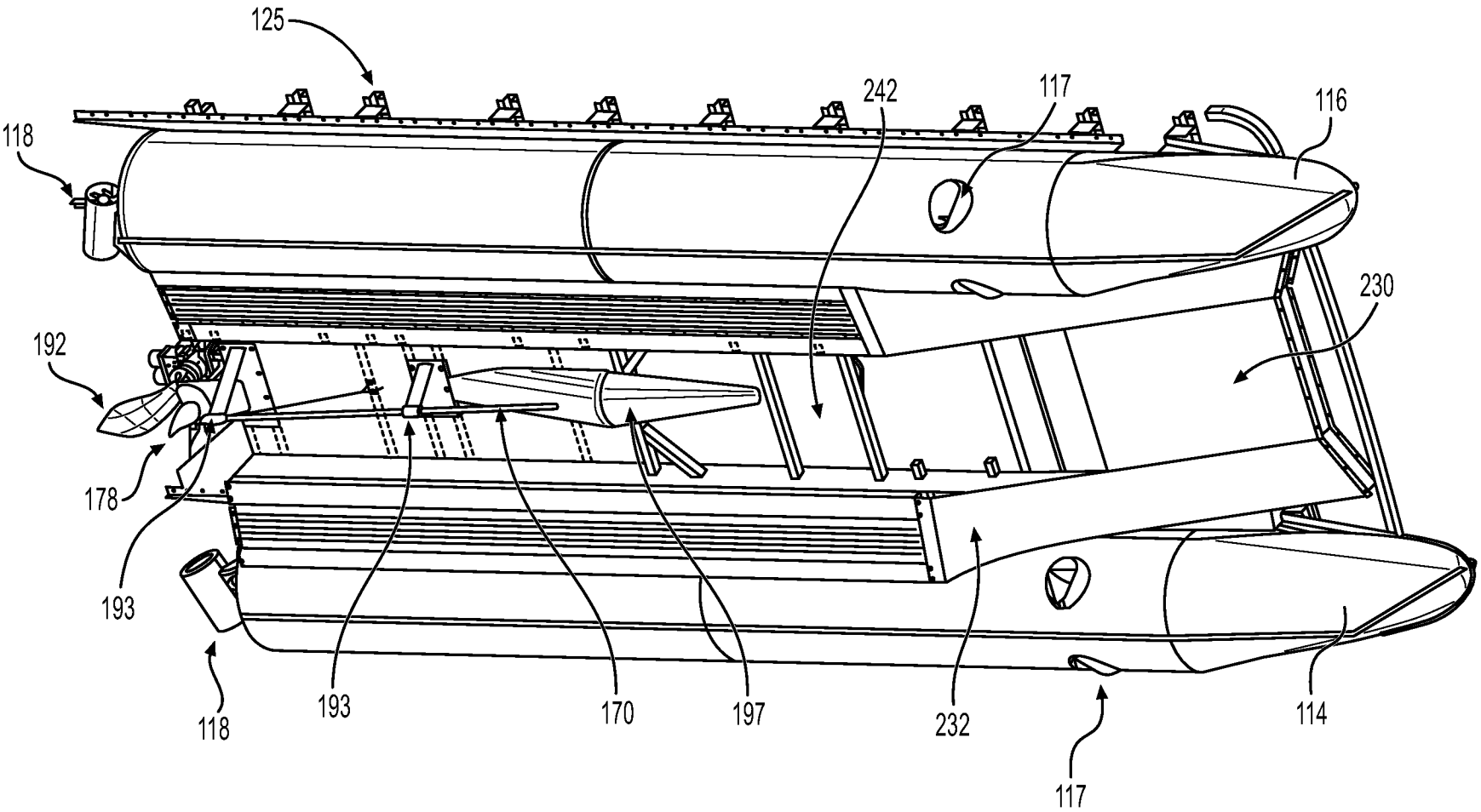
FIG. 11 is a bottom, right side perspective view of another embodiment of a hull for a watercraft, with the pontoon tubes and the support structure of FIG. 4.
Figure 12:
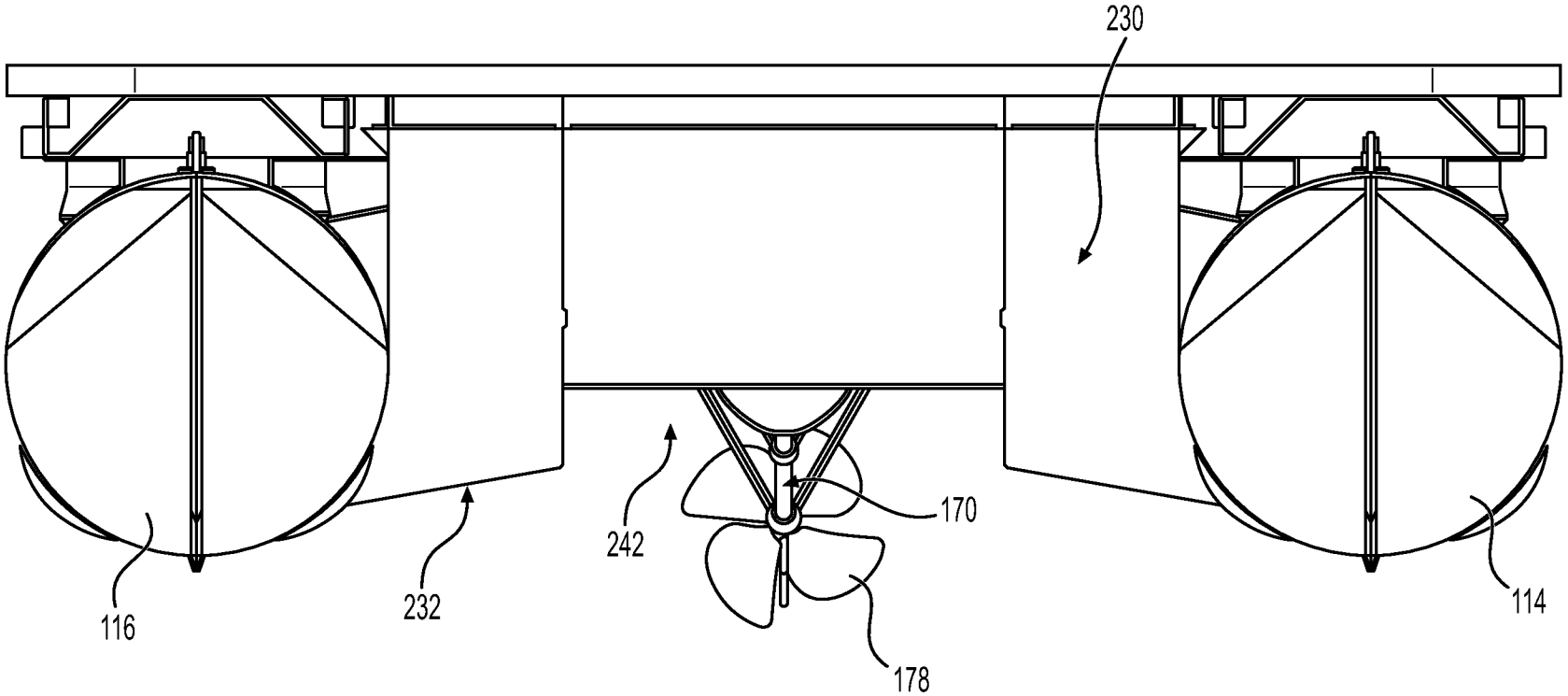
FIG. 12 is a rear elevation view of the hull, the pontoon tubes, and the support structure of FIG. 11.

As can be further seen in FIGS. 3 and 9, the bottom surface 132 extends laterally inward and downward from each tube 114, 166 toward the channel 142. FIGS. 11 and 12 illustrate another embodiment a hull 230, with a different arrangement of a channel 242 and a bottom surface 232. In the embodiment of the hull 230, the channel 242 is wider and shallower than the channel 140, with the bottom surface 232 extending slightly upward as it extends inward from the tubes 114, 116. This forms a slightly shallower channel 242, with the channel 242 also being slightly wider than the channel 142. The exact form of the bottom surface 132 or 232 used in any given embodiment of the watercraft 100 could depend on numerous details specific to the embodiment of the watercraft 100, including but not limited to: weight of the watercraft 100, operational details of the propeller 178, and other hydrodynamic factors. It is contemplated, for example, that another embodiment of a hull could have a differently shaped bottom surface, include the form of the channel and the angles (in both lateral and longitudinal orientations) of the inclined surfaces. While the cross-sectional shapes of the channels 142, 242 illustrated herein are generally rectangular in form, it is also contemplated that the cross-sectional shape of the channel could vary in different embodiments.

While the hull 130 is described herein as a hull having a channel, it is contemplated that the illustrated embodiment could also be considered a watercraft 100 having a multi-hull 130. Considered in this terminology, the multi-hull 130 would then include a left hull 107 and a right hull 109 (identified thusly in FIG. 3), with the channel 142 defining the space between the hulls 107, 109.

Figure 7:
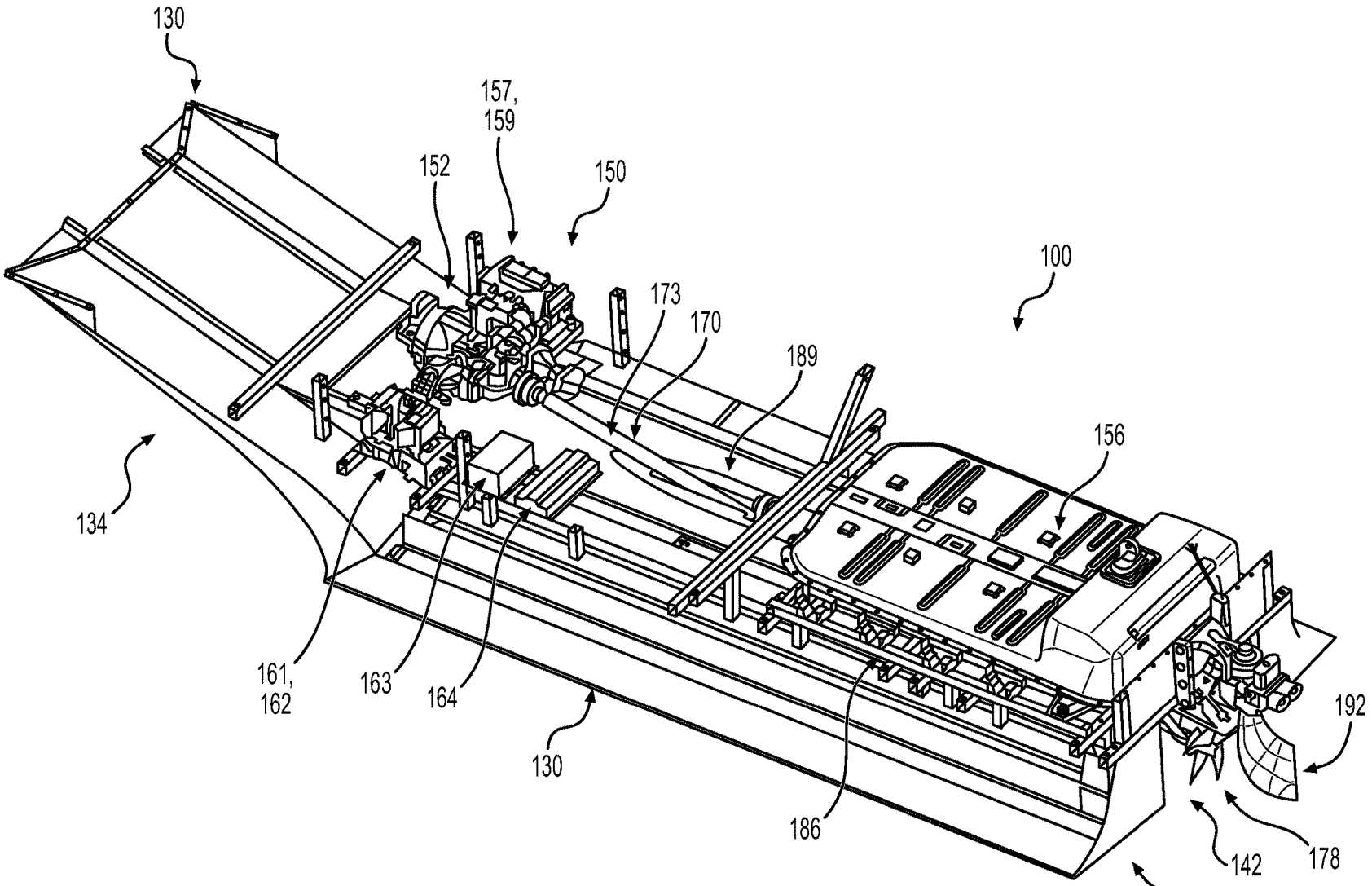
FIG. 7 is a top, rear, left side perspective view of a hull, propulsion system, and a rudder of the watercraft of FIG. 1.
Figure 8:
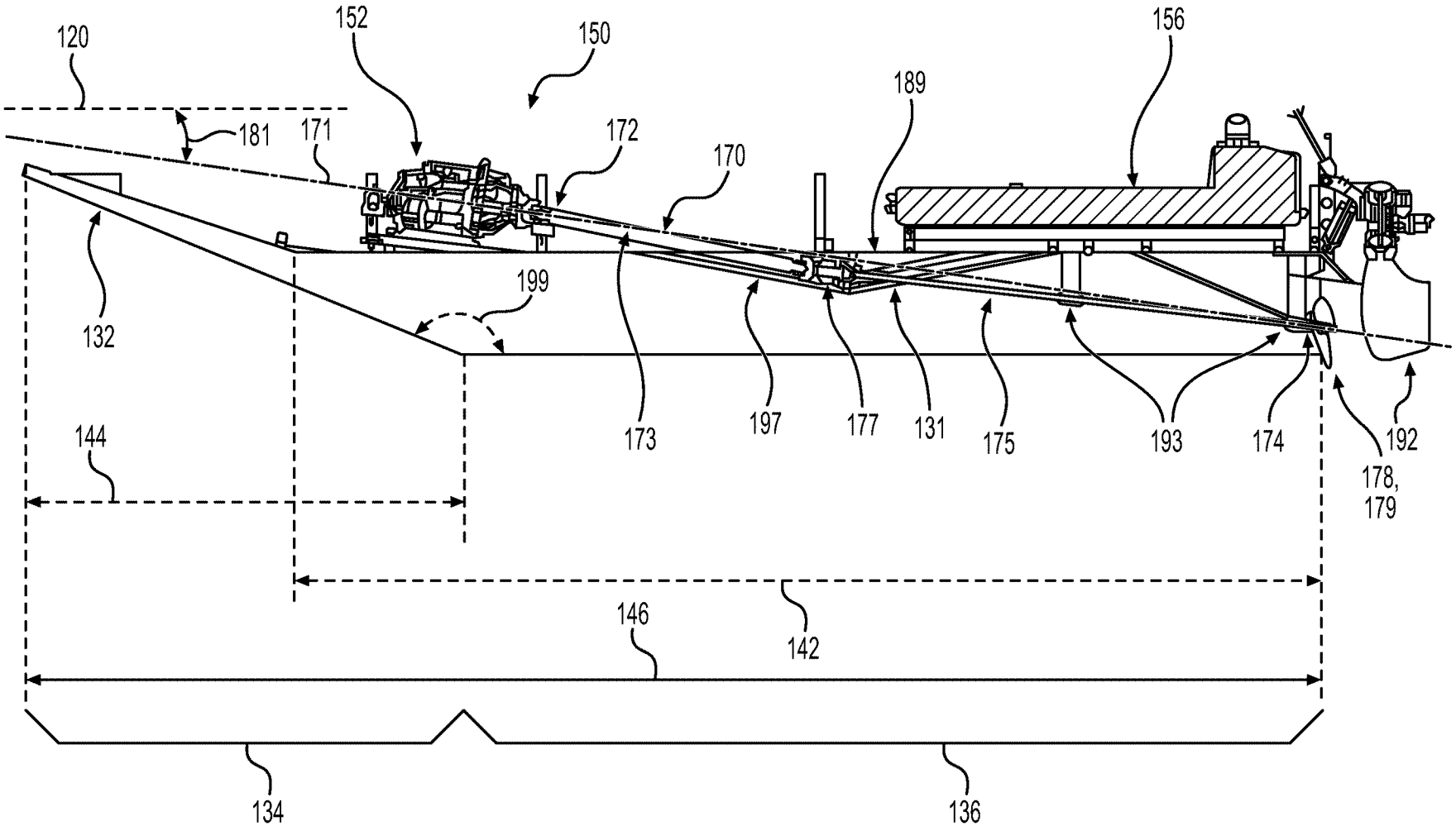
FIG. 8 is a cross-sectional view of the hull, the propulsion system, and the rudder of FIG. 7.

In FIGS. 6 to 8, the inboard electric propulsion system 150 propelling the watercraft 100 is illustrated. The propulsion system 150 is disposed below the deck 120, with portions of the system 150 being received in the volume 188 defined between the hull 130, the deck 120, and the tubes 114, 116.

The propulsion system 150 includes a plurality of electrical components disposed between the hull 130 and the deck 120. As is mentioned above, seams formed at boundaries between the hull 130, the deck, and/or the tubes 114, 116 are not necessarily sealed and are water-permeable. As such, the electrical components of the system 150 are waterproof to an Ingress Protection Code standard of IP67. It is contemplated that different standards could be applied, depending on the particular embodiment or desired application.

The plurality of electrical components of the system 150 include an electric motor 152 disposed in a forward portion of the watercraft 100. The electric motor 152 is disposed above the bottom surface 132 of the hull 130 and below the deck 120. More specifically, the motor 152 is disposed between the hull 130 and the support structure 125 in the present embodiment. An acceleration lever (not shown) is operatively connected to the electric motor 152 for controlling operation of the motor 152. The acceleration lever is located on a command console (not illustrated), also referred to as a helm, provided on the deck 120. It is contemplated that different input and control mechanisms could be used for controlling the motor 152 by an operator.

In order to power the motor 152, the electronic components of the system 150 also include a battery pack 156, referred to herein generally as the battery 156, disposed in a rear portion of the watercraft 100. Similarly to the motor 152, the battery 156 is disposed above the bottom surface 132 of the hull 130 and below the deck 120. As can be seen in FIG. 4, a majority of the battery 156 extends under the support structure 125 in the present embodiment, with a portion extending upward between two of the lateral rigid members 128. The exact arrangement of the battery 156 and the support structure 125 could vary in different embodiments, depending on the arrangement of the support structure 125 and the configuration of the battery 156. The electric motor 152 is electrically connected to the battery 156 by a plurality of waterproof power supply cables (not illustrated) although the number and style of electrical connection between the motor 152 and the battery 156 could vary.

Both the battery 156 and the electric motor 152 are disposed vertically over the channel 142, supported by a receiving surface 189 formed by a top surface of the hull 130 where it extends over the channel 142. When considering the hull 130 as the multi-hull 130, the receiving surface 189 extends above the channel 142 and between the left hull 107 and the right hull 109. As can be seen in FIG. 7, the battery 156 is connected to a battery support structure 186 connected to the surface 189, although connection details relating to the battery 186 could vary for different embodiments.

In the illustrated embodiment the watercraft 100 has a center of buoyancy 101 located in a center region of the watercraft 100 (see in FIG. 6). The exact position of the center of buoyancy 101 could vary in different embodiments. By positioning the electric motor 152 (as well as additional components 157, 159, 161, 162, 163, 164 described below) in a forward portion of the watercraft 100, forward of the center of buoyancy 101, and the battery 156 in a rear portion of the watercraft 100, rearward of the center of buoyancy 101, the weight of the electrical propulsion system 150 is distributed through the watercraft 100.

The propulsion system 150 further includes electronic management and conversion components communicatively connected to the motor 152, as can be seen in at least FIG. 6. These components include a DC-DC converter 157 that provides current for the low voltage electronics and a charger unit 159 disposed to the right of the motor 152. The electronic components also include a regulator unit 161 that regulates power distribution, an inverter 162, a thruster system battery 163 for powering the thrusters 117, 118, and a boost converter 164 disposed to the left of the motor 152. The exact arrangement of the motor 152 and the electronic components 157, 159, 161, 162, 163, 164 could vary in different embodiments.

It is contemplated that the watercraft 100 could also include additional and/or alternative electronic or electrical components, for example, for controlling the propulsion system 150 and for managing operation of the watercraft 100. These components could include, but are not limited to, electronic cooling system, passenger accessory systems, navigation systems, watercraft control systems, and communication systems.

The propulsion system 150 includes a propulsion shaft 170 operatively connected to the electric motor 152 for driving the propeller 178. A front end 172 of the propulsion shaft 170 is connected and driven by the motor 152. From the front end 172 at the motor 152, the propulsion shaft 170 extends downward and rearward from the motor 152 toward the rear 104 of the watercraft 100 along the longitudinal center plane 108. As will be described further below, the propulsion shaft 170 passes from inside the hull 130 outward into the channel 142, thereby connecting the motor 152 disposed inside the volume 188 to the propeller 178 arranged to be submerged when the watercraft 100 is in operation.

The propeller 178 is connected to and supported by a rear end portion 174 of the propulsion shaft 170. The propeller 178 is disposed generally rearward of the channel 142, although precise longitudinal placement of the propeller 178 could vary for different embodiments. The propeller 178 is a four blade, fixed-pitch propeller which rotates about a center of rotation 179, although the particular form of the propeller 178 could vary.

The watercraft 100 also includes a rudder 192 pivotally connected to the hull 130 behind the propeller 178. In some embodiments, the rudder 192 could be additionally or alternatively pivotally connected to a rear portion of the deck 120. A steering wheel (not shown) on a command console (not illustrated) on the deck 120 is operatively connected to the rudder 192. It is contemplated that the steering wheel could be replaced by a handlebar in some embodiments.

As can be seen in FIG. 8, the propulsion shaft 170 is formed from a driveshaft 173 operatively connected to the motor 152 and a propeller shaft 175 connected to the propeller 178. A coupling 177, also referred to as an aquadrive 177, connects the propeller shaft 175 to the driveshaft 173. The coupling 177 allows for a small relative movements between the propeller shaft 175 and the driveshaft 173 to aid in impeding transfer of vibration from the propeller 178 to the motor 152. The coupling 177 further provides for a small relative angle between the axes of rotation of the propeller shaft 175 and the drive shaft 173, such that the propeller shaft 175 is closer to horizontal without requiring a shallower angle of the drive shaft 173 as it extends from the motor 152.

A drive axis 171 is defined for the watercraft 100 which describes the overall angle at which the propulsion shaft 170 is arranged in the watercraft 100. The drive axis 171 is defined by a line 171 extending through the front end 172 of the propulsion shaft 170 and through the center of rotation 179 of the propeller 178. As is illustrated, the drive axis 171 does not necessarily align with the driveshaft 173 and/or the propeller shaft 175, as the coupling 177 allows for the small relative angle between the axes of rotation of the two shafts 173, 175. The drive axis 171 extends downward and rearward from the deck 120 at a drive angle 181 of less than 15 degrees to the deck 120. In the present embodiment, the drive angle 179 is approximately 11 degrees. Placement of the motor 152 in the forward portion of the watercraft 100, in addition to optimizing weight distribution, further aids in minimizing relative angling of portions the propulsion shaft 170 and to provide a preferred angle for the drive axis 171.

The propulsion shaft 170 extends through a shaft aperture 131 in the hull 130 and into the channel 142. The shaft aperture 131 is defined in a portion of the bottom surface 132 defining a top of the channel 142. As can be seen in FIGS. 3 and 8 for the hull 130 and in FIG. 11 for the hull 230, the watercraft 100 includes a coupler recess 197 which protrudes into a top side of the channel 142. In the present embodiment, the shaft aperture 131 is defined in a rear side of the coupler recess 197. The propeller shaft 175 passes through the shaft aperture 131, as the coupling 177 is disposed in the recess 197 in the receiving surface 189. The coupling 177 is thereby disposed lower than a topmost point of the channel 142 while reducing drag that would otherwise be caused by the coupler 177 extending into the channel 142. It is contemplated that the coupling 177 could be arranged above the channel 142 and the recess 197 omitted in some embodiments. Rearward of the recess 197 and the shaft aperture 131, the propeller shaft 175 is supported by two journal bearing support structures 193. In some embodiments, more or fewer supports 193 could be included or additional and/or alternative mechanisms for supporting the propulsion shaft 170 could be employed.

As is illustrated schematically in FIG. 9, the watercraft 100 further includes buoyant material 180 disposed between the hull 130 and the deck 120, within the volume 188. The buoyant material 180 is included in the present embodiment in order to maintain buoyancy in case of water infiltration into the volume 188. As is mentioned above, the hull 130 is not sealably connected to the deck 120 and/or the tubes 114, 116 in order to reduce the complexity of construction of the watercraft 100. It is noted that the volume 188 itself aids in increasing the buoyancy of the watercraft 100 to aid in compensating for the weight of the electric propulsion systems 150, compared to a standard pontoon with a combustion-based propulsion system, and it is contemplated that the buoyant material 180 could be omitted in embodiments where the volume 188 is sealed to be waterproof.

The buoyant material 180 fills lower portions of the volume 188. The volume 188 is generally separated into two zones by a channel top plane 143, which is defined by a plane 143 passing laterally through a top-most point of the channel 142. The buoyant material 180 is received in portions of the volume 188 below the channel top plane 143. The receiving surface 189 is above the channel top plane 143, such that the electronic equipment, including the motor 152 and the battery 156, is disposed above and separated from the buoyant material 180. In some embodiments, there could additionally be a physical barrier between these regions.

Figure 10:
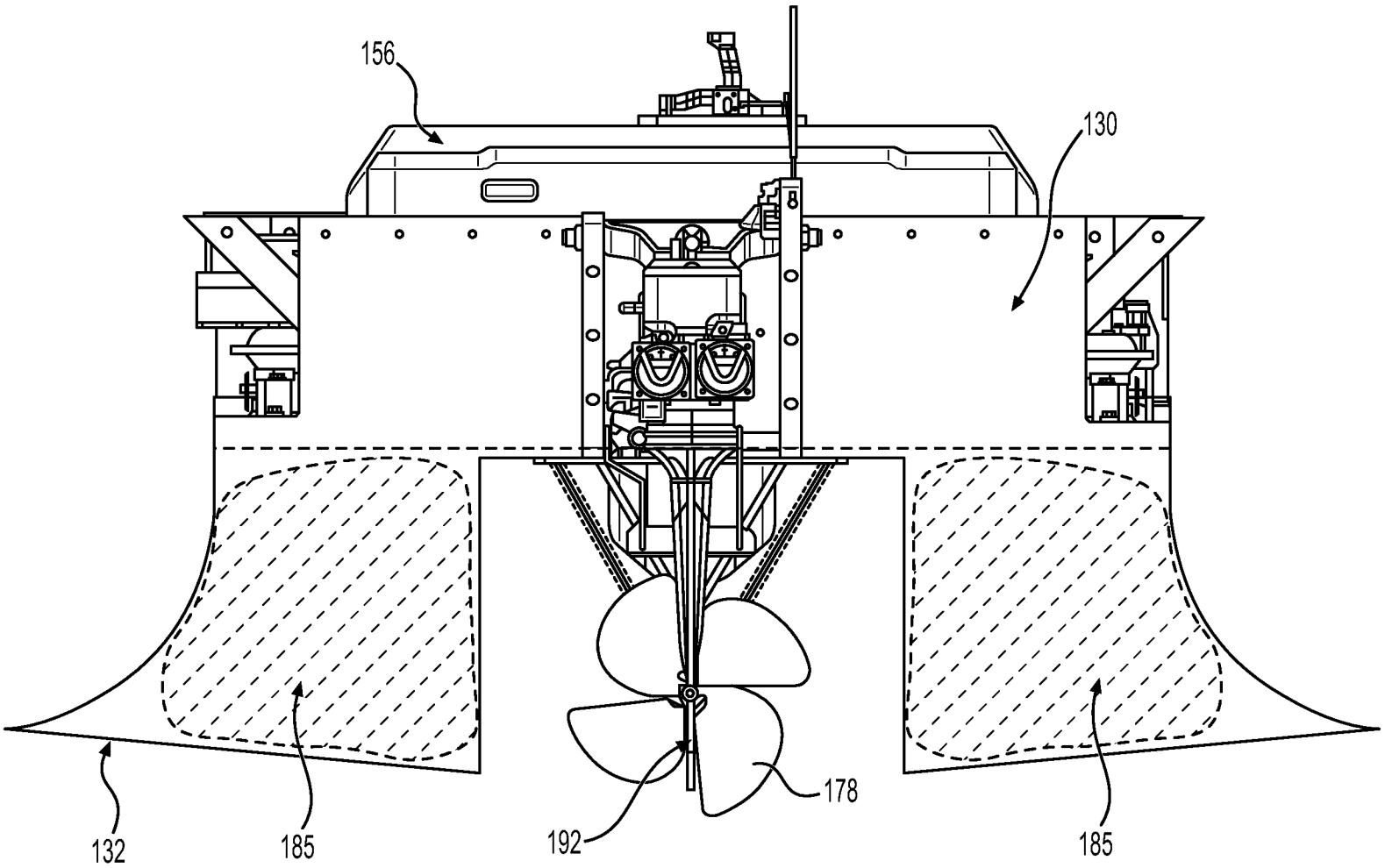
FIG. 10 is a rear elevation view of the hull, the propulsion system, and the rudder of FIG. 7, with another embodiment of buoyant material illustrated schematically.

In the embodiment of FIG. 9, the buoyant material 180 is marine floatation foam 180. The foam 180 is installed in the watercraft 100 by spraying a foam-mixture into lower portions of the volume 188, which then expands to fill the lower portions as the flotation foam 180 sets. The marine floatation foam 180 maintains buoyancy of the watercraft 100 and is water-resistant so that water infiltrating the volume 188 is not absorbed by the material therein and does not decrease buoyancy of the watercraft 100. It is contemplated that different kinds of foam could be used in some embodiments, for example pre-formed blocks of marine floatation foam or other types of closed-cell foam. FIG. 10 illustrates another embodiment a buoyant material disposed in the lower portion of the volume 188, specifically two waterproof air bladders 185. As is mentioned above, in some embodiments the hull 130 could be sealed such that water could not infiltrate into the volume 188.

It is further contemplated that portions of the present technology could be applied in retrofitting an existing pontoon boat to produce the electric watercraft 100. Specifically, the hull 130, with the electric propulsion system 150 connected thereto, could be connected to an existing deck and pair of pontoon tubes connected there.

Modifications and improvements to the above-described embodiments of the present technology may become apparent to those skilled in the art. The foregoing description is intended to be exemplary rather than limiting. The scope of the present technology is therefore intended to be limited solely by the scope of the appended claims.

What is claimed is:

1. A watercraft comprising:

a hull including a bottom surface, a channel being defined by the bottom surface;

a deck disposed above the hull;

a battery disposed in a rear portion of the watercraft, the battery being disposed rearward of a center of buoyancy of the watercraft, the battery being disposed above the bottom surface of the hull and below the deck;

an electric motor disposed in a forward portion of the watercraft, the electric motor being disposed above the bottom surface of the hull and below the deck, the electric motor being electrically connected to the battery;

a propulsion shaft operatively connected to the electric motor at a front end of the propulsion shaft, the propulsion shaft extending downward and rearward from the electric motor, the propulsion shaft passing through the bottom surface of the hull and extending into the channel;

a propeller connected to a rear end portion of the propulsion shaft; and a rudder pivotally connected to at least one of the hull and the deck.

2. The watercraft of claim 1, wherein the bottom surface of the hull includes:

a first portion including at least one inclined surface extending downward and rearward from a front edge portion of the bottom surface; and a second portion extending rearward from the first portion at an angle from the first portion.

3. The watercraft of claim 2, further comprising:

a right pontoon tube disposed to a right of the hull and below the deck; and a left pontoon tube disposed to a left of the hull and below the deck:

wherein the at least one inclined surface includes:

a right surface section disposed laterally between the channel and the right pontoon tube, and a left surface section disposed laterally between the channel and the left pontoon tube.

4. The watercraft of claim 2, wherein an interior angle formed by the at least one inclined surface and the second portion of the bottom surface is at least 140 degrees.

5. The watercraft of claim 4, wherein the interior angle formed by the at least one inclined surface and the second portion of the bottom surface is approximately 160 degrees.

6. The watercraft of claim 2, wherein a front edge of the first portion is a connected to a bottom surface of the deck.

7. The watercraft of claim 2, wherein a longitudinal length of a horizontal projection of the first portion is equal to at least 20% of an overall length of the watercraft.

8. The watercraft of claim 2, wherein the channel is defined in one of: at least the second portion of the bottom surface, or in the first portion of the bottom surface and the second portion of the bottom surface.

9. The watercraft of claim 1, wherein:

a shaft aperture is defined in the hull; and the propulsion shaft extends through the shaft aperture.

10. The watercraft of claim 1, wherein:

a drive axis is defined by a line extending through:

the front end of the propulsion shaft, and a center of rotation of the propeller; and the drive axis extends downward and rearward from the deck at a drive angle of less than 15 degrees.

11. The watercraft of claim 1, wherein the channel extends along a longitudinal center plane of the watercraft.

12. The watercraft of claim 1, further comprising buoyant material disposed between the hull and the deck.

13. The watercraft of claim 12, wherein the electric motor and the battery are disposed vertically higher than the buoyant material.

14. The watercraft of claim 12, wherein at least one area of contact between the hull and the deck is water-permeable.

15. The watercraft of claim 1, wherein the propeller is disposed at least partially rearward of the channel.

16. The watercraft of claim 1, wherein a longitudinal length of the hull is at least 4 meters and less than 8 meters.

17. The watercraft of claim 1, wherein:

the hull is a multihull including at least:

a left hull, and a right hull; and the channel is defined between the left hull and the right hull.

18. The watercraft of claim 17, wherein:

the hull includes a surface extending above the channel and between the left hull and the right hull; and the battery and the electric motor are received on the surface.

19. The watercraft of claim 1, wherein a width of the channel is approximately 25% of a total width of the watercraft.

20. A watercraft comprising:

a hull including a bottom surface, a channel being defined by the bottom surface;

a deck disposed above the hull;

a battery disposed in a rear portion of the watercraft, the battery being disposed above the bottom surface of the hull and below the deck;

an electric motor disposed in a forward portion of the watercraft, the electric motor being disposed above the bottom surface of the hull and below the deck, the electric motor being electrically connected to the battery;

a propulsion shaft operatively connected to the electric motor at a front end of the propulsion shaft, the propulsion shaft extending downward and rearward from the electric motor, the propulsion shaft passing through the bottom surface of the hull and extending into the channel;

a propeller connected to a rear end portion of the propulsion shaft, the propeller being disposed at least partially rearward of the channel; and a rudder pivotally connected to at least one of the hull and the deck.

21. The watercraft of claim 1, wherein the battery is centered on a longitudinal center plane of the watercraft.

* * * * *